United States Patent [19]

Fleischhacker et al.

[11] 4,127,312

[45] Nov. 28, 1978

[54] MODULAR CONNECTOR FOR CONNECTING GROUPS OF WIRES

[75] Inventors: James E. Fleischhacker, Winston-Salem, N.C.; Henry G. Wasserlein, Jr., Seminole, Fla.; James A. Kloth, deceased, late of St. Petersburg, Fla., by Marion L. Kloth, administrator

[73] Assignee: AMP Incorporated, Harrisburg, Pa.

[21] Appl. No.: 783,127

[22] Filed: Mar. 31, 1977

Related U.S. Application Data

[63] Continuation-in-part of Ser. No. 630,589, Nov. 10, 1975, abandoned.

[51] Int. Cl.[2] ..... H01R 13/38

[52] U.S. Cl. ..... 339/99 R

[58] Field of Search ..... 339/97-99

[56] References Cited

U.S. PATENT DOCUMENTS

| | | | |
|---|---|---|---|
| 2,701,346 | 2/1955 | Powell | 339/176 MP |
| 3,132,913 | 5/1964 | Pohl | 339/97 P |
| 3,189,863 | 6/1965 | Leach | 339/99 R |
| 3,239,796 | 3/1966 | Buchanan et al. | 339/97 P |
| 3,496,522 | 2/1970 | Ellis, Jr. et al. | 339/99 R |
| 3,877,771 | 4/1975 | Jensen et al. | 339/99 R |
| 3,923,362 | 12/1975 | Dunn et al. | 339/99 R |

*Primary Examiner*—Joseph H. McGlynn
*Attorney, Agent, or Firm*—Anthony S. Volpe

[57] ABSTRACT

Multi-conductor electrical connector comprises a body member having oppositely directed first and second faces and contact terminals mounted therein. The terminals have wire-receiving portions extending from the first face and have receptacle portions on the second face, the receptacle portions being dimensioned to be mated with a contact portion of a similar or identical terminal. The first and second faces are complementary to each other so that the connector body can be plugged at both faces to another connector body. The connector body can be used with an identical connector body or with other housing parts to form a pluggable multi-wire splice, a tap connection, and to install new equipment in a telephone cable.

12 Claims, 29 Drawing Figures

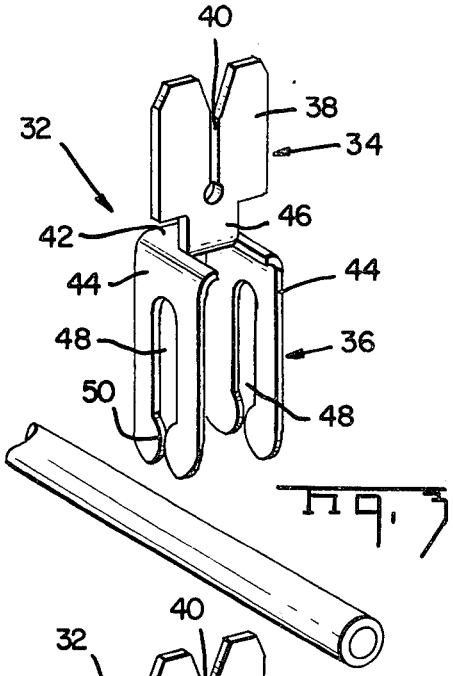
Fig. 3
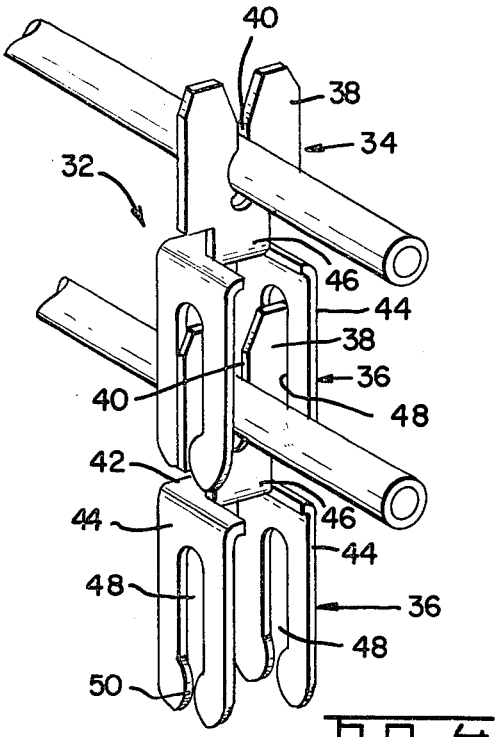
Fig. 4
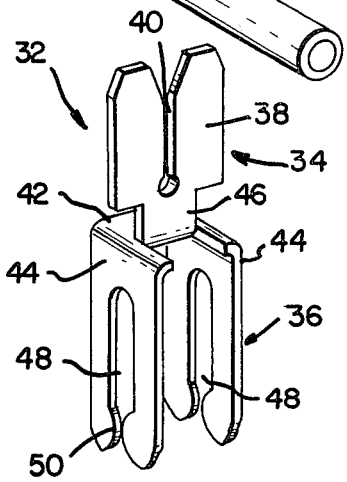
Fig. 5
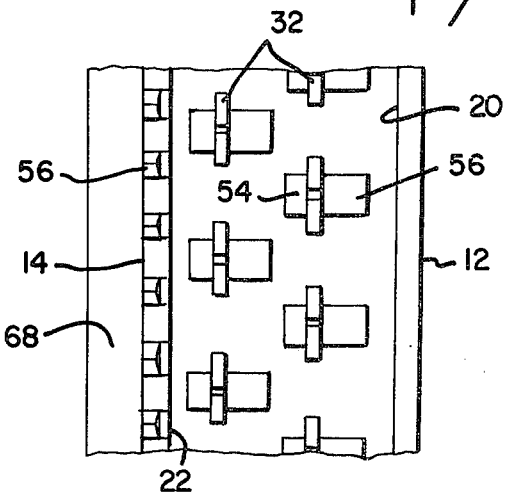
Fig. 6
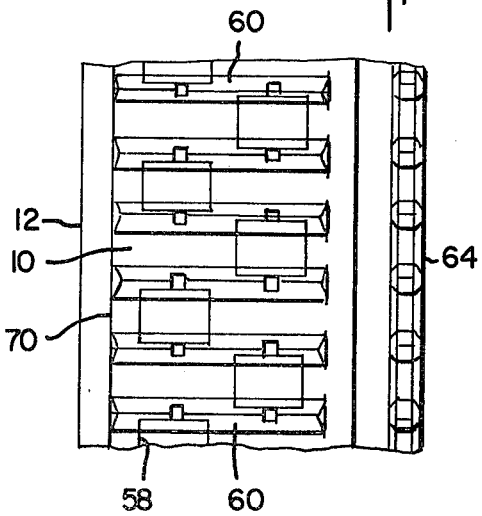

MODULAR CONNECTOR FOR CONNECTING GROUPS OF WIRES

BACKGROUND OF THE INVENTION

This application is a Continuation-In-Part of application Ser. No. 630,589 filed Nov. 10, 1975 now abandoned.

This invention relates to a connector system comprising a connector body having contacts therein which can be mated with an identical or similar body and which can be unplugged from the identical body at will. The invention will find extensive use in the communications industry and the invention is herein described with particular reference to the communications industry although other uses for the principles of the invention will be apparent.

An everyday task which is carried out with great frequency in the telephone industry is that of connecting the individual wires in a first bundle of wires to the individual wires in a second bundle of wires. For example, communications cables comprise one or more bundles of wires, each bundle containing 25 pairs of wires. When a telephone cable line is installed, the cable is supplied in predetermined lengths and the end of each cable section in the line must be spliced to the end of the next section which means that all of the individual wires in the cable must be spliced to each other in individual connections. Splicing operations must also be carried out whenever new equipment, such as a switch system or a load coil system, is installed.

Originally, these splicing operations were carried out by wire twist splicing or by means of crimpable electrical connecting devices, one crimpable connecting device serving only to connect a single wire to a single wire in the two cable ends. More recently, conductor splicing operations have been carried out by modular multi-contact connectors as shown, for example, in U.S. Pat. Nos. 3,772,635, 3,708,779, 3,239,796, and 3,611,522 and modular connectors are now widely used in the telephone industry. In general, the preferred forms of modular connectors of the types described in the foregoing patents comprise a connector module which has contact terminals therein which are adapted to receive the wires which are to be connected, the terminals having wire-receiving slots at both of their ends. These connectors also have some provision for making tap connections to a cable, as by the use of a special tap module which is coupled with, or plugged onto the main connector module in which the through wires are connected.

The presently available modules for cable splicing or bundle splicing operations have, at best, limited pluggability; that is, it is possible to make a tap connection to a cable by plugging a tap module into a main module but the pluggability of the modules used is limited, at best, to such tap applications.

The instant invention is directed to the achievement of a modular multi-contact connector for splicing operations which has the advantage of unlimited pluggability or mateability with identical or similar connector modules. This feature of unlimited pluggability is particularly desirable in the telephone industry for several reasons; for example, when changes are made in a telephone cable, the pre-existing connections can be broken by merely unplugging two mated connector parts and the new equipment can be installed by merely mating the unplugged parts with complementary or identical connector parts on cables extending from the new equipment. Under many circumstances, the changes which may be required to a telephone system can be effected without interrupting the service as by the use of jumper cables during changes to the system.

It is accordingly an object of the invention to provide an improved multi-contact electrical connector. A further object is to provide a multi-contact electrical connector which can be mated with two similar or identical electrical connectors. A further object is to provide a compact multi-contact electrical connector which is suitable for use in the communications industry.

These and other objects of the invention are achieved in preferred embodiments thereof, which are briefly described in the foregoing abstract, which are described in detail below, and which are shown in the accompanying drawing in which:

FIG. 3 is a perspective view of two contact terminals of the type used in the connector body of FIG. 1.

FIG. 4 is a view similiar to FIG. 3 but showing wires connected to the terminals and the terminals mated to each other.

Figure 2:
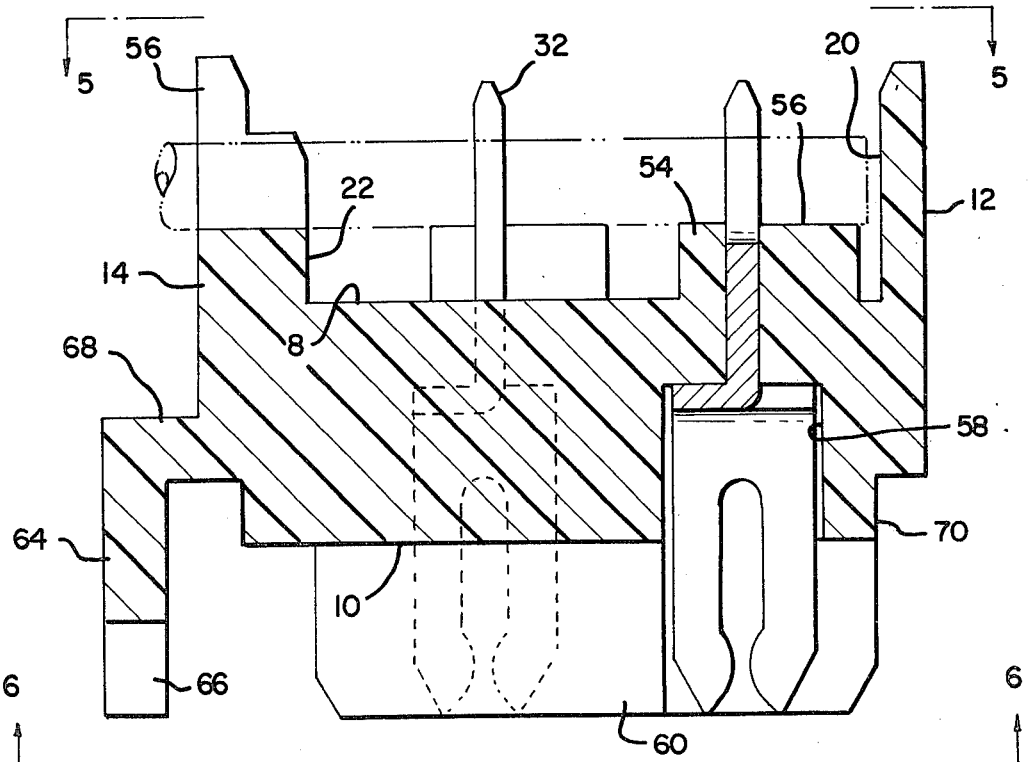
FIG. 2 is a cross sectional view taken along the lines 2—2 of FIG. 1.

FIGS. 5 and 6 are views taken along the lines 5—5 and 6—6 of FIG. 2.

Figure 7:
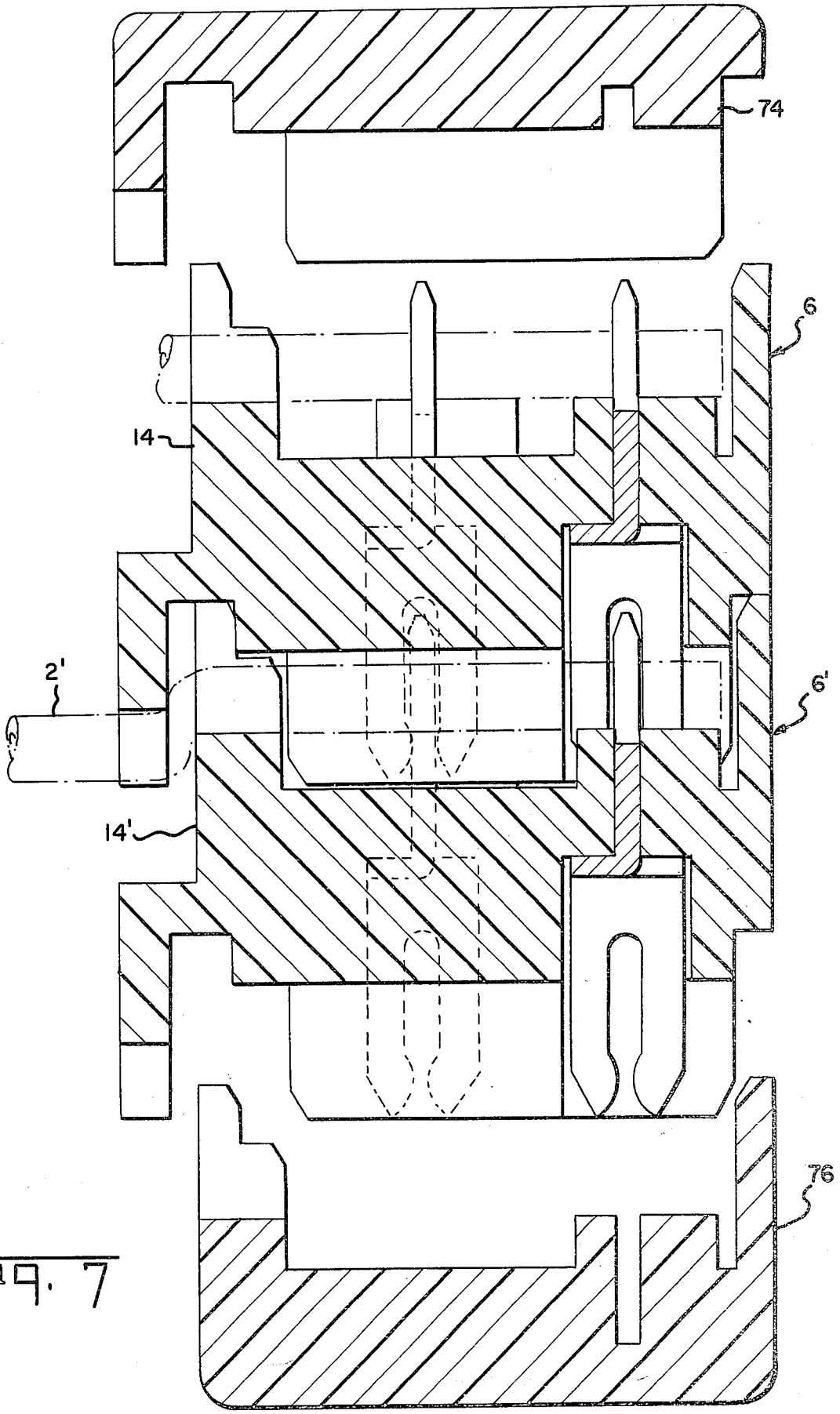

FIG. 7 is a cross sectional view showing two connector bodies mated with each other.

Figure 1:
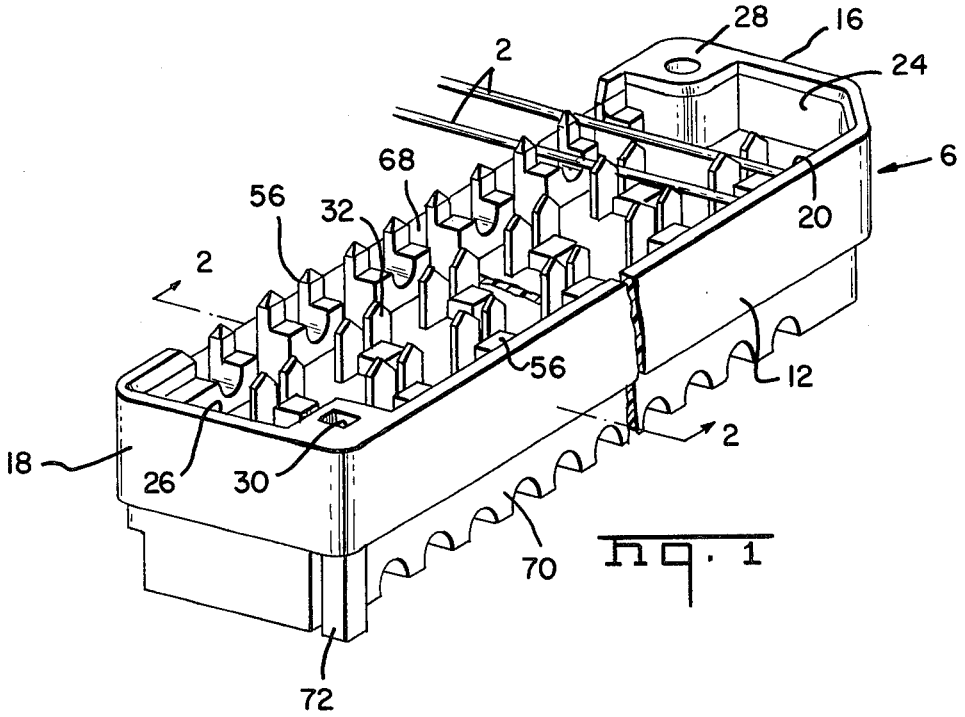
FIG. 1 is a perspective view of a preferred form of connector body in accordance with the invention.
Figure 8:
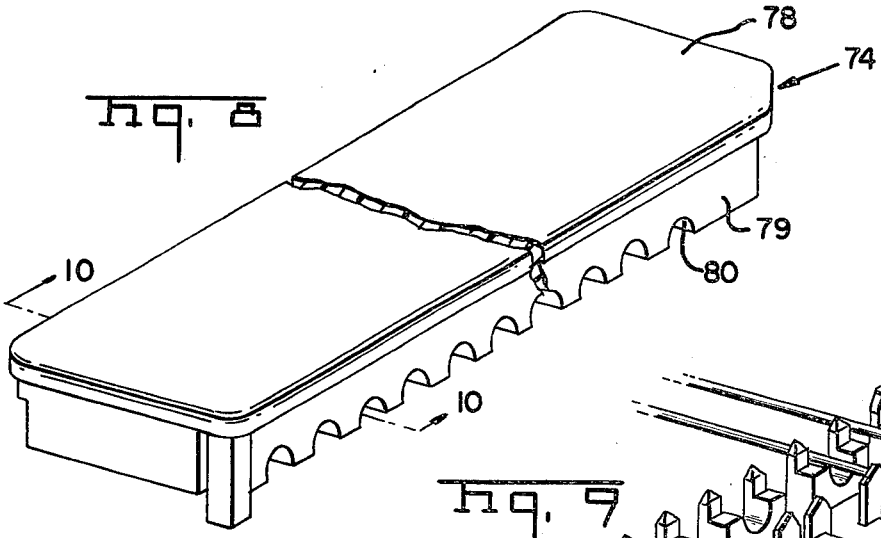

FIG. 8 is a perspective view of a cover member which is used with a connector body of the type shown in FIG. 1.

Figure 9:
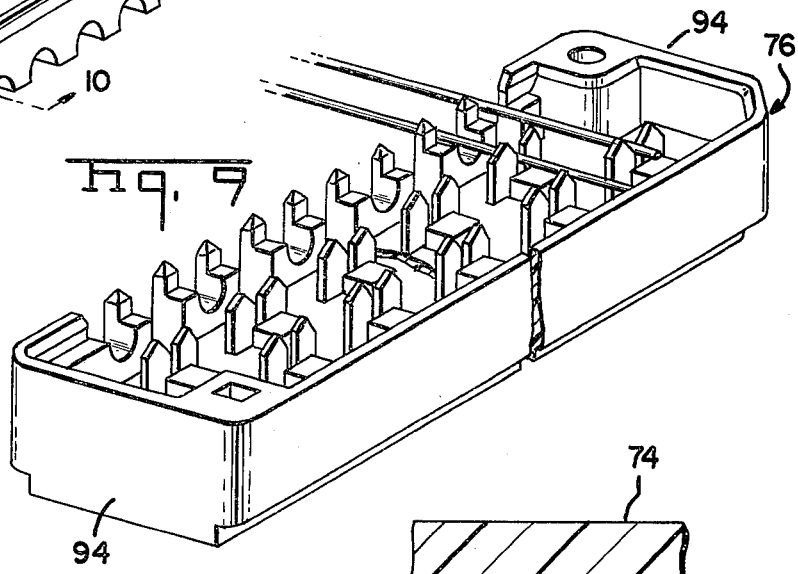

FIG. 9 is a perspective view of a base member which is used with a connector body of the type shown in FIG. 1.

Figure 10:
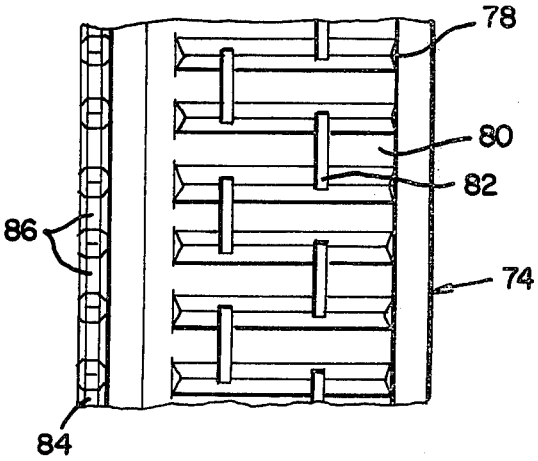

FIG. 10 is a view taken along the lines 10—10 of FIG. 8.

Figure 11A:
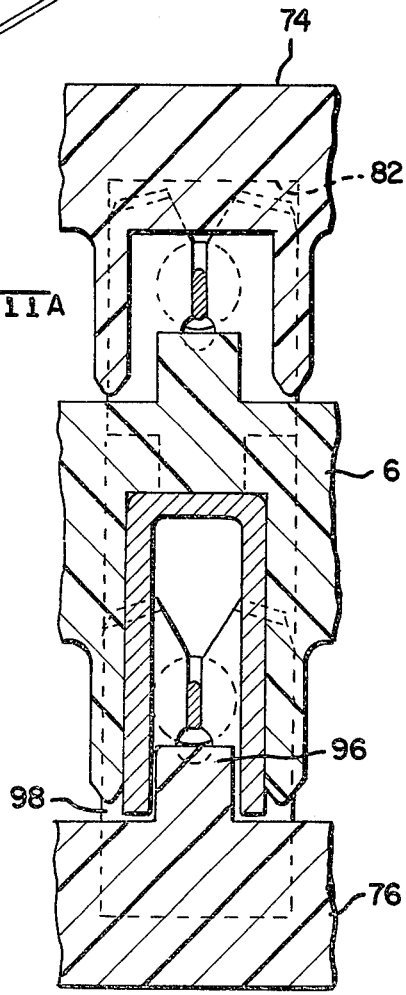
Figure 11:
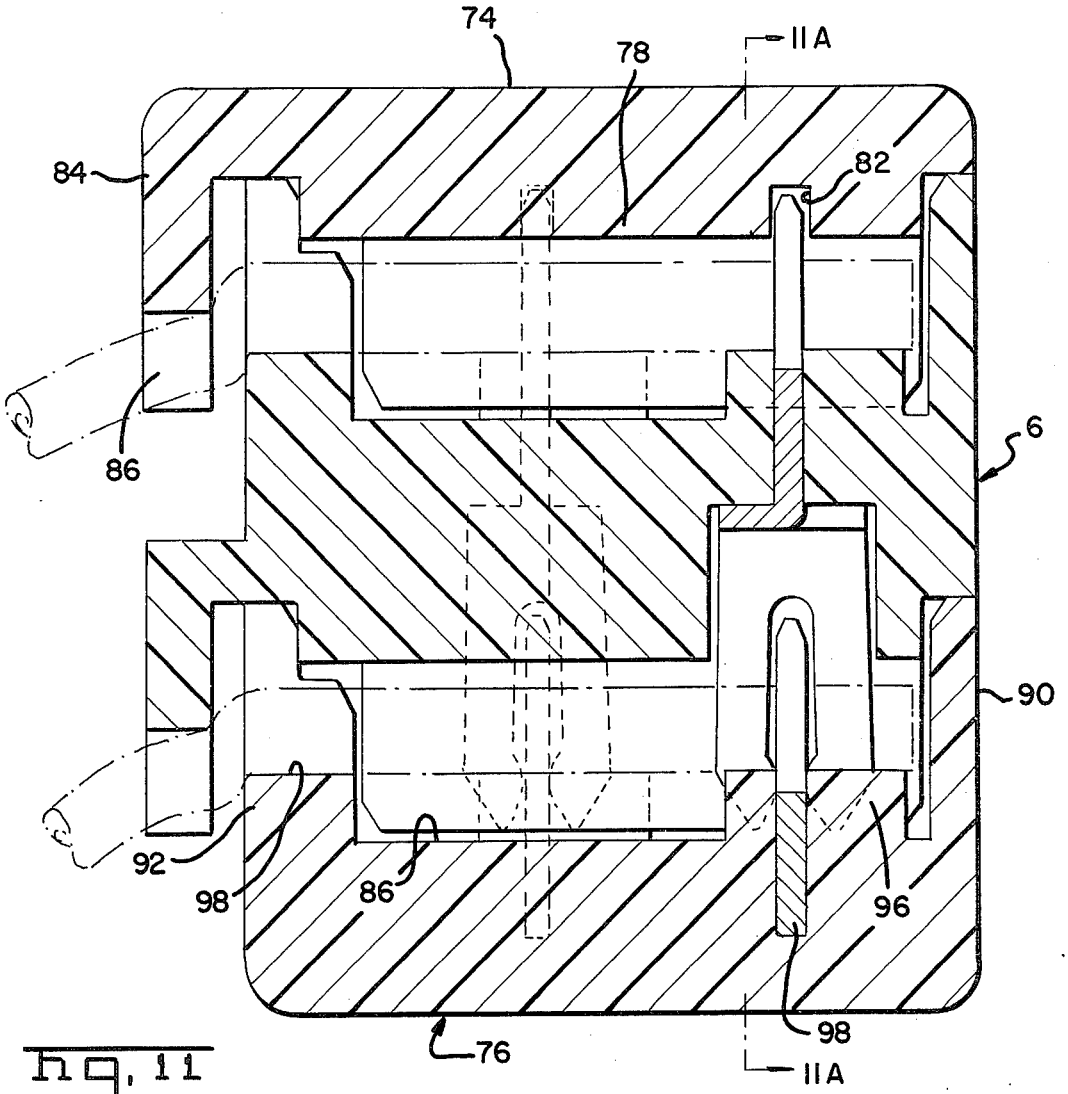

FIG. 11 is a cross sectional view of a bundle splice assembly comprising a connector body and base and cover members.

FIG. 11A is a view taken along the lines 11A—11A of FIG. 11.

Figure 12:
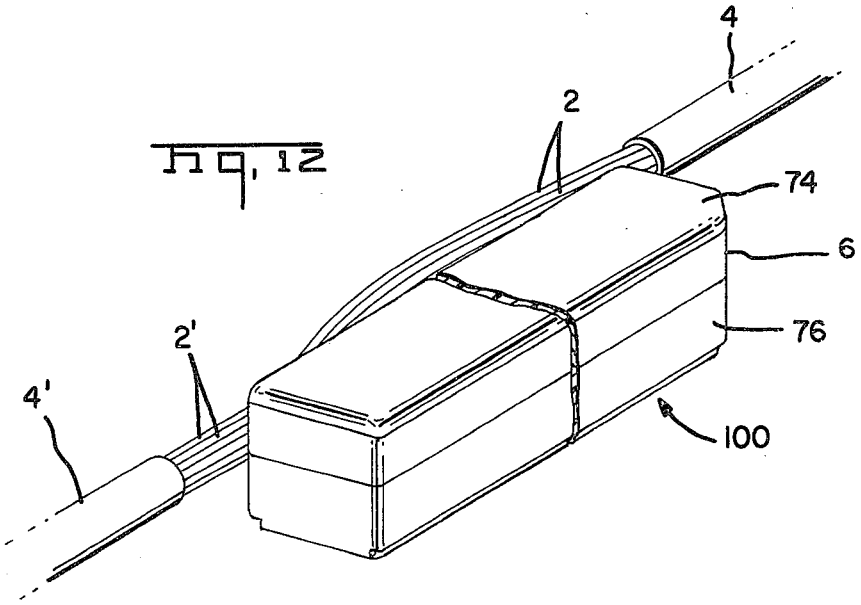

FIG. 12 is a perspective view of the connector assembly of FIG. 11.

Figure 13:
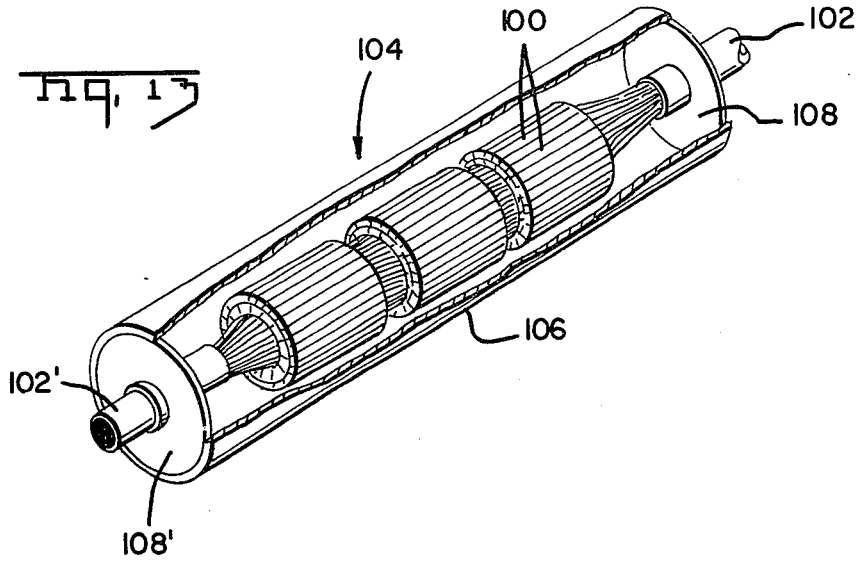

FIG. 13 is a perspective view, with parts broken away, of a splice between two multi-conductor cables in which the bundles in the cables are connected by means of a plurality of connector assemblies of the type shown in FIG. 12.

Figure 14:
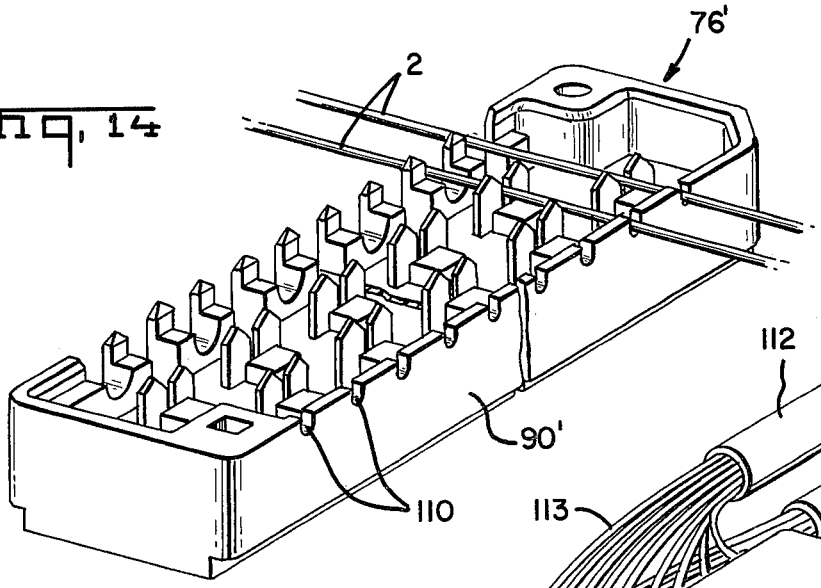

FIG. 14 is a perspective view of a modified form of base member which is used to make a tap connection to a wire bundle.

Figure 15:
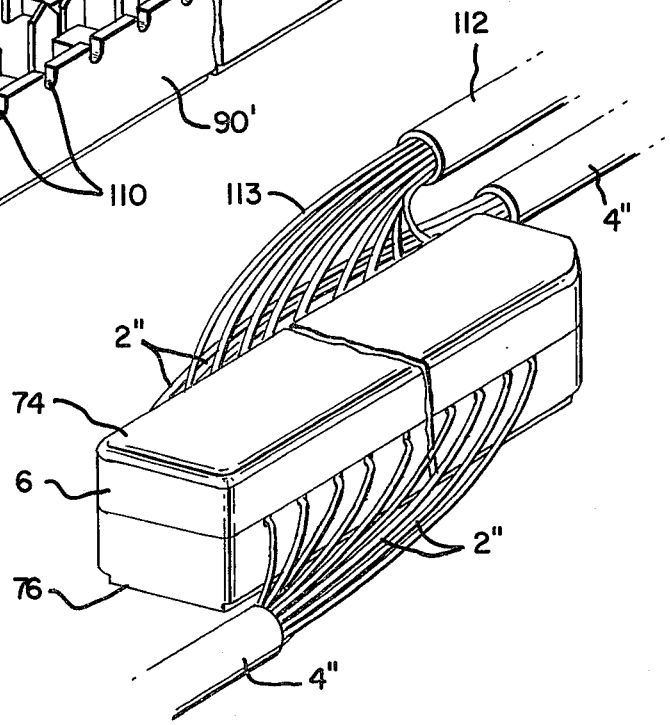

FIG. 15 is a perspective view of a tap connection to a wire bundle in which the connections are made by an assembly including the base member of FIG. 14.

FIGS. 16–27 are a series of diagramatic views which illustrate the use of the principles of the invention in installing and removing equipment on electrical cables.

Figure 28:
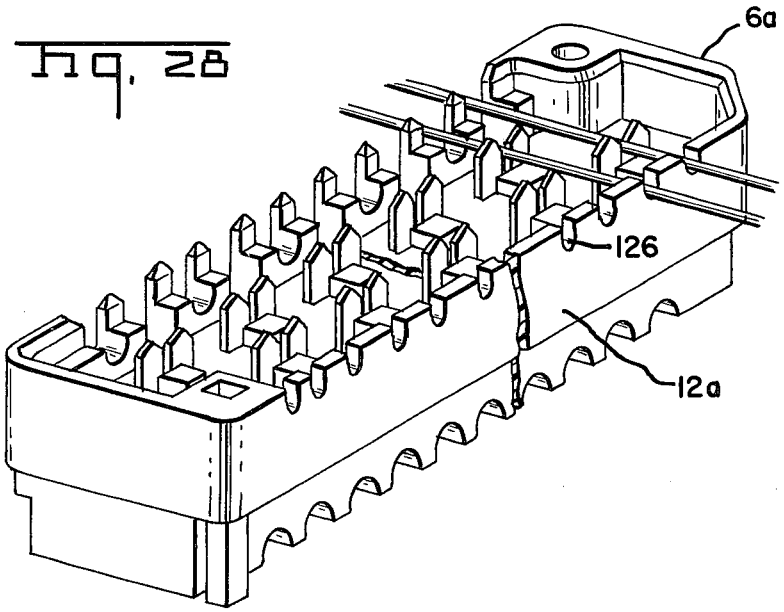

FIG. 28 shows an alternative embodiment.

The connection system in accordance with the invention comprises a connector body 6, FIGS. 1 and 2, which is intended to be installed on the ends of wires 2 in a bundle 4 and which can be used in conjunction with an identical connector body or with a base member 76 to connect the individual wires 2, for example, wires 2' in a bundle 4'. In the description which follows, connector body 6 will be described in detail and the other parts will subsequently be described.

The body 6 is generally prismatic having oppositely directed first and second faces 8, 10, external sidewalls 12, 14, and external end walls 16, 18. The face 8 is recessed as shown in FIG. 2 and is surrounded by internal sidewalls 20, 22 and internal end walls 24, 26. Integral bosses or heavy sections are provided in diametrically opposite corners as shown at 28, 30 on the face 8 and polarizing openings extend into the surfaces at these corners.

The body 6, and the cover member and base member described below, are of insulating material and are preferably manufactured by an injection molding process of a material such as glass-filled nylon or polyester.

A plurality of stamped and formed electrical contact terminals are mounted in, and extend through, the body 6 and are arranged in two parallel spaced-apart rows with the terminal of each row being offset from the terminals of the other row. Each terminal 32, FIG. 3, comprises a wire-receiving portion 34 and a receptacle portion 36, the wire-receiving portion comprising a plate-like member having a wire-receiving slot 40 extending inwardly from its upper end as viewed in the drawing. The width of the slot 40 is such that the opposed edges of the slot will displace the insulation of a wire during movement of the wire into the slot and establish electrical contact with the conducting core of the wire.

The receptacle portion 36 is U-shaped in cross section and comprises a web 42 and sidewalls 44. The wire-receiving portion 34 is connected to the web 42 by means of a reduced width neck 46. The sidewalls 44 have receptacle slots 48 extending upwardly from their lower ends and the entry portions 50 of the slots are constricted as shown so that when the wire-receiving portion 34 of the lower terminal shown in FIG. 3 is moved upwardly to the portion of FIG. 4, the constricted contact portions 50 will engage the surface of the lower terminal and establish electrical contact. It will be noted that the wire-receiving portion 34 of each terminal defines a plane which intersects the parallel planes defined by the receptacle sidewalls 44. It should also be noted that the width of the plate-like portion 38 is greater than the distance the sidewalls so that a portion of the wire-receiving portion 34 projects beyond the outwardly facing surfaces of the sidewalls of a mated terminal as shown in FIG. 4.

The terminals 32 are assembled to the body member 6 by inserting the wire-receiving portions 34 of the terminals through openings which extend between the faces 8, 10 so that the upper ends of the wire-receiving portions project above the face 8 and above the upper surfaces 56 of bosses 54 which are provided at the locations of the terminals on the face 8. These bosses serve to support the wire-receiving portions of the terminals against bending and the upper surface 56 of each boss serves as a wire stop when the wires are inserted into the slots 40 of the terminals. The side 14 of the body 6 constitutes a wire-receiving side and is provided with spaced-apart notches 56, each notch being in alignment with the slot 40 in one of the terminals 32 and as shown in FIG. 2.

The receptacle portions 36 of the terminals are received in recesses 58 which extend inwardly from the second side 10 of the connector body. Transverse barriers 60 extend across the face 10 and separate adjacent terminals from each other as shown in FIG. 6. The recesses 56 have shallow grooves 62 on opposite surfaces to provide clearance for the projecting edge portions of the wire-receiving portion 38 of a mated terminal when the body 6 is mated with an identical body 6' (FIG. 7) or with a base member 76 which is described below.

In order to provide a strain relief for the wires, a depending flange 64 extends downwardly on the left hand side of the body as viewed in FIG. 2 and is offset from the side 14 by a connecting section 68. This flange is provided with spaced-apart notches 66 on its lower edge which are located such that they will be in registry with the notches 56 of a connector body plugged against the face 10 as shown also in FIG. 7. Since the notches 66 and the notches 56 of the adjacent connector body are offset from each other, a slight kink is produced in the wire 2 and the kink prevents the transmission of an excessive tensile pull on the wire to the electrical connection between the wire and the terminal.

The face 8 and the internal sidewalls and end walls 20, 22, 24, 26 are complementary to the face 10 so that the connector body 6 can be plugged at either of its faces to an identical connector and it can also be plugged at its lower face 10 to a base member 76 which is described below. Thus the sidewall 12 is recessed as shown at 70 so that the sidewall of the lower connector body 6' in FIG. 7 will be received against the recessed surface and the flange 64 is outwardly offset so that it will be spaced from the sidewall 14' of the lower connector 6'. A square polarizing pin 72 is provided in one of the corners of the body and a circular pin (not shown) is provided at the opposite corner for entry into the square and circular openings in the corners 28, 30 of an identical connector.

The wires 2 of a bundle 4 can be connected to the wire-receiving portions 34 of the terminals by the use of a suitable insertion tool such as the insertion tool shown in U.S. Pat. No. 3,972,101 of the insertion tool shown in application Ser. No. 740,999 filed Nov. 11, 1976. As will be apparent from FIG. 7 and as is explained in detail below, the wires 2 of the bundle 4 can, therefore, be connected to the wires 2' of the bundle 4' by simply connecting the wires 2 to the terminals of the connector 6, connecting the wires 2' to the terminals and the connector 6', plugging the two connector bodies to each other. When a cable or bundle splice of the type shown in FIG. 7 is made, it is desirable to cover the upper surface of the body 6 with a cap member 74 and to assemble a base member 76 against the lower face 10 of the connector body 6'. The base member in FIG. 7 would not, however, be provided with terminals 98 as described below but would merely serve as a protective cover.

FIGS. 8 and 9 show the cover member 74, and the base member 76 which are used with the body member 6 when it is desired to splice the wires of two bundles in the most compact manner obtainable. The cover 74 comprises a generally rectangular molding 78 which is recessed along its sides as shown at 79 so that it can be fitted into the upwardly facing face of the body member 6 as shown in FIG. 11. This cover member has transversely extending flutes 80 which provide clearance for the wires and it is recessed as shown at 82 to provide clearance for the upper ends of the wire-receiving terminals in the body member 6. The cover member also has an offset depending flange 84 having notches 86 in its lower edge which provide the strain relief function previously described.

The base member 76 has an internal surface 78 which is surrounded by sidewalls 90, 92 and end walls 94. The surface 86 is provided with bosses 96 which similar to the previously described bosses 54 in the body member 6 and the terminals 98 extend through these bosses and into the body of the base member. The terminals are simple plate-like members in this instance having upper wire-receiving portions which conform dimensionally to the wire-receiving portions 34 of the terminals 32. Base 76 is, of course, designed to be plugged against the face 10 of a body member 6 and has an upwardly extending sidewall 92 which is provided with notches 98 for cooperation with the notches 66 in the body member. These notches provide the strain relief function previously described.

FIG. 12 shows a completed and assembled splice assembly 100 comprising a base member 76, a body member 6, and a cover member 74. The wires 2 of the cable 4 are connected to the wire 2' of the cable 4' by means of this connector assembly with the wires 2 extending into the body member and the wires 2' extending into the terminals 97 in the base member 76.

The principles of the invention permit the achievement of a connector module for a standard wire bundle containing twenty-five pairs of wires in a minimum amount of space. For example, the preferred form of connector assembly 100 in accordance with the invention has a length of about 5.3 inches, a height of about 0.58 inches, and a width of 0.58 inches. These minimum dimensions are achieved by virtue of the fact that the cover member 74 and the base member 76 are of minimum thickness consistent with the achievement of good dielectric characteristics. The minimum length is achieved, in part, by the fact that the terminals overlap each other, the terminals of each row extending beyond the terminals of the achievement row on the first face 8 as is apparent from an inspection of FIG. 5.

A splice assembly of the type shown in FIG. 12 will ordinarily be used when it is necessary to connect or splice the end of a first cable 102 to the end of an adjacent cable 102'. In this field, each cable will have a plurality of twenty-five pair of bundles and a connector assembly 100 is required for each bundle splice. After all of the bundles in the cables have been connected to each other by means of individual connector assemblies 100, the entire splice containing all of the assemblies is enclosed in a splice closure 104 which has a cylindrical envelope or cover 106 and circular end plates 108, 108'. Standard specifications which are followed in the telephone industry dictate that such splice closures should have a length of no more than 19 inches from cable sheath to cable sheath. The connector assembly in accordance with the invention permits the placement of three circumferential stacks of assemblies 100 in this limited space.

FIGS. 14 and 15 illustrate the manner of connecting a branch cable 112 to a pre-existing through cable 4'', both of these cables comprising a single bundle of wires 113 and 2''. A branch of tap connection can be made without interruption to serve in the cable 4'' by substituting an alternative base member 76' for the base member 76 previously described. The base member 76' differs from the base member 76 only in that the sidewall 90' has notches 110 extending into its upper edge which are in alignment with the individual terminals. The wires 2'' of the cable 4'' are connected to the terminals by simply removing the sheath from a portion of the cable and inserting the individual wires into the terminals without cutting the wires so that they emerge through the notches 110 in the base. This operation of inserting the wires 2'' can be carried out with a tool of the type shown in U.S. Pat. No. 3,972,101 by removing the cutter bar from the tool which ordinarily trims the wires prior to inserting the wires.

The wires 113 of the cable 112 are inserted into the terminals 32 of a body member 6 of the type shown in FIG. 1 and this body member is then plugged to the base member 76' so that the tap wires 113 are connected to the proper wires 2'' in the cable 4''. The installation of a body member on the end of the cable 112 can, if desired, be carried out in a factory or a service installation rather than in the field so that the technician need only prepare the cable 4'' at the work site and plug the connector parts together.

It should be mentioned at this point that when a new telephone line is being installed, the connector parts, the body member 6 and the base member 76 can be installed on the end of the cable in a factory and after the cable is transported to the field and installed in underground conduits or on telephone poles, the cable ends can be spliced by simply plugging the connector parts to each other at the end of each cable section.

Figure 16:
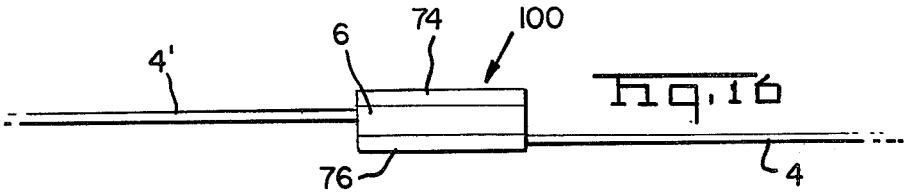
Figure 17:
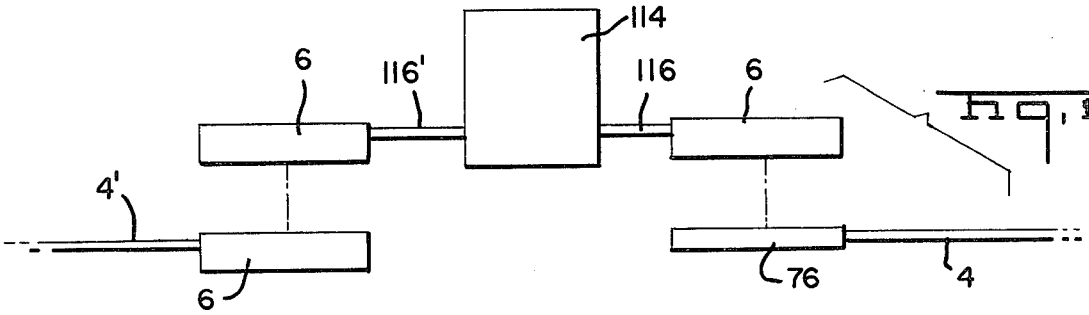
Figure 18:
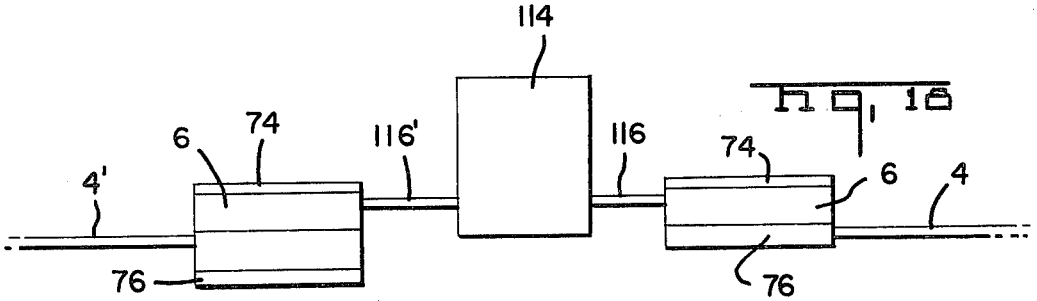

FIGS. 16 and 17 show diagramatically the manner in which additional equipment 114 can be placed in series in a cable 4, 4' containing a splice assembly 100. The additional equipment 114 may be in the form of a load coil or the like which is ordinarily supplied with stub bundles of wires 116, 116' extending therefrom. Ordinarily these wires would be connected in the cable in the field by any of the known prior art methods. In accordance with the invention, however, the wires 116, 116' can be provided with connector bodies 6 on their ends so that when the equipment 114 is installed, it is merely necessary to unplug or disassemble the parts 74, 6, 76 of the splice assembly 100, plug the part 6 on the cable 4' to the body member 6 on the cable 116', plug the body member 6 on the stop cable 116 to the base member 76 on the cable section 74, and assembly cap members 74 to both of the splices. The installation of the additional equipment 114 thus requires only some simple plugging and unplugging operations and the equipment 114 can be removed at a later time by following reverse procedures and reassembling the connector assembly 100 of FIG. 16.

Figure 19:
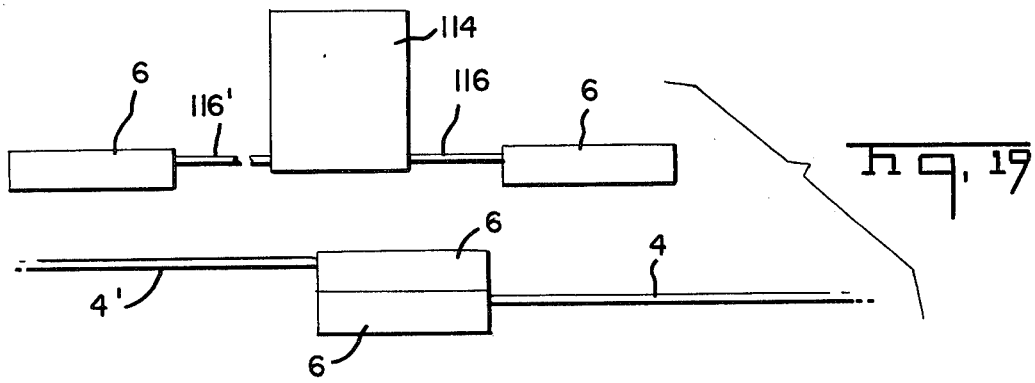
Figure 20:
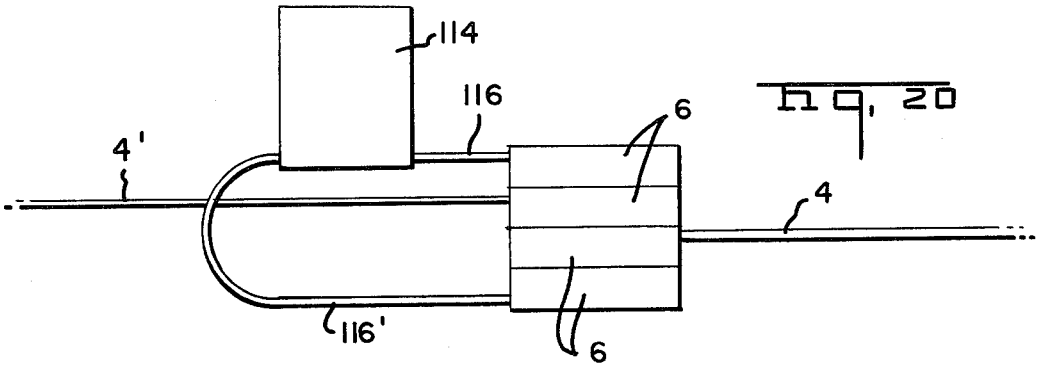
Figure 21:
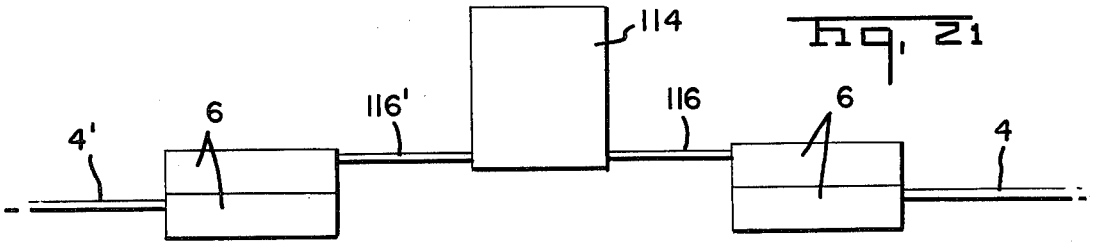

FIGS. 19–21 show an alternative method of installing additional equipment 114 which is accomplished without any interruption of service in the cable 4, 4'. In this instance, the ends of the cable 4, 4' are spliced by main body members 6 which are plugged to each other. As before, the additional equipment has main body members 6 on its cables 116, 116'. In order to install the equipment without interruption of service in the cable 4, 4', the connector bodies 6 on the cables 116, 116' are plugged to the connector bodies on the ends of the cables 4, 4' as shown in FIG. 20. At this stage, the additional equipment is in parallel with the conductors in the cables 4, 4'. Thereafter, the connector bodies 6 which are on the ends of the cables 4, 4' are unplugged from each other while they remain plugged to the identical connector bodies 6 on the cables 116, 116'. The additional equipment is now in series with the conductors in the cables 4, 4'.

Figure 22:
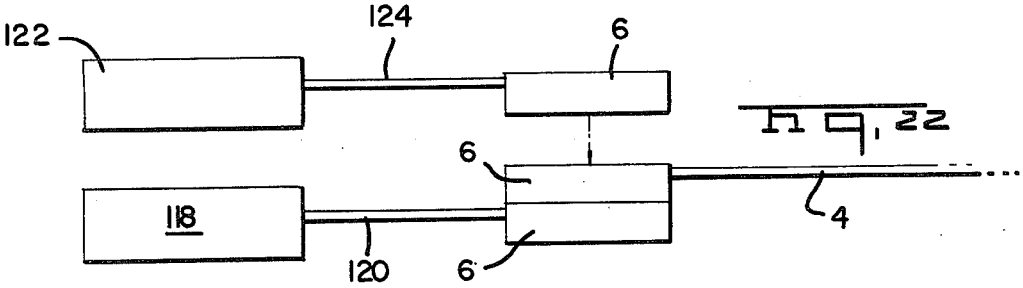
Figure 23:
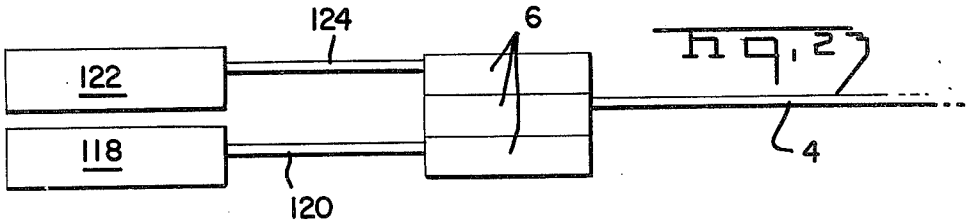
Figure 24:
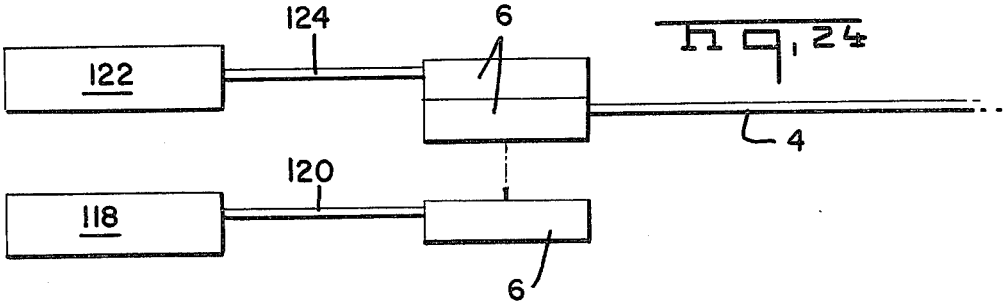

FIGS. 22–24 illustrate the use of the invention under circumstances where a cable 4 having a body member 6 on its end is connected through the body member to a body member 6 on the end of a cable extending from equipment 118 which, in this instance, can be assumed to be a cross bar switch. The older cross bar switches are being replaced in many parts of the telephone system by electronic switching systems diagramatically indicated at 122 in FIG. 19. The electronic switching system 122 can be placed in service without interruption of service in the cable 4 by providing a body member 6 on the ends of the conductors 124 which extend from the electronic switching system 122. The installation of body member 6 on cable 124 would be carried out in the factory and the switching system transported to the site of installation. The body member 6 on the cable 124 is plugged into the upper face of the body member 6 on the cable 4, FIG. 23, so that both of the switching systems would be plugged into the line 4 for a brief interval. Thereafter, the body member 6 on the cable 120 is unplugged from the lower face of the body member on cable 4 leaving only the electronic switching system 122 in the system. The cross bar switch 118 in FIG. 24 can be put to further use and since it has a body member 6 on its conductors 120, it can be installed at a different location by merely plugging it into the system. A changeover of this type might take place, for example, when a cross bar switch is replaced by an electronic switching system in an important application and the cross bar switch is later used in a different system such as a PBX system.

Figure 25:
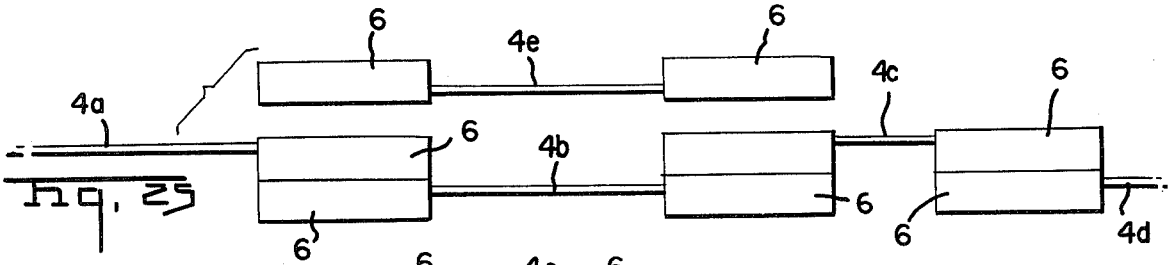
Figure 26:
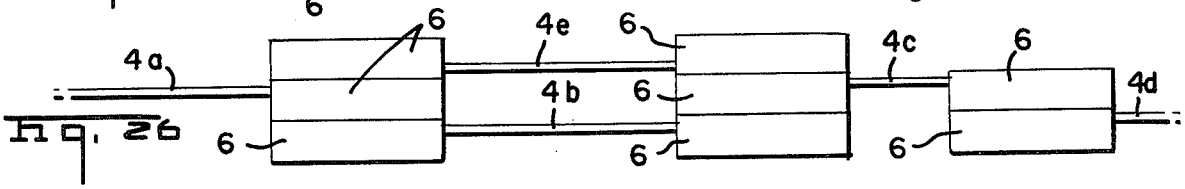
Figure 27:
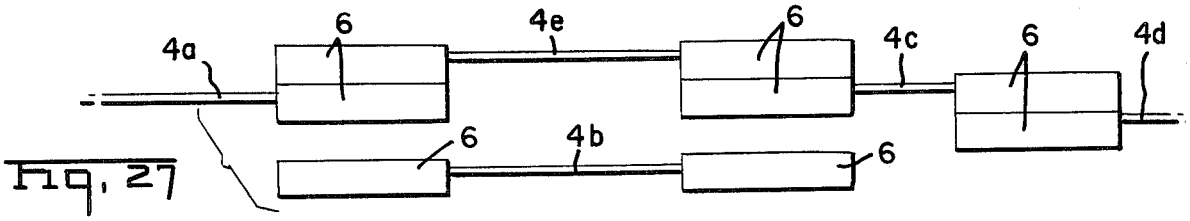

FIGS. 25–27 illustrate the manner in which a defective cable section can be replaced without interruption of service in the entire cable. In FIG. 25, a continuous cable comprises cable sections 4*a*, 4*b*, 4*c*, and 4*d*, the ends of the cable sections in all instances being connected or spliced by connector bodies 6. If the cable section 4*b* is defective, for example, if the insulation on the wires is deteriorated so that it is "noisy", it can be replaced by a new section of cable 4*e* which is of the same length as section 4*b* and which also has connector bodies 6 on its ends. The connector bodies on the ends of cable section 4*e* are simply plugged to the upper faces as viewed in FIG. 25 of the bodies 6 on cable sections 4*a* and 4*c* as shown in FIG. 26. Sections 4*b* and 4*e* are now in parallel and section 4*b* can be removed as shown in FIG. 27 to return the cable to its original condition.

It will be apparent that a wide variety of cable modifications and changes can be made by the use of the body section 6 without any interruption in the service in the cable to which the equipment is being added or the changes being made. FIGS. 19–27 illustrate changes which can be made when the ends of the cable sections are terminated with either connector bodies 6 or, as shown in FIG. 16, a connector body 6 and a base section or body 76. It will be apparent from FIGS. 19–27 that the connector body 6 offers more options for cable changes than does the base section for the reason that the body 6 can receive an identical body at both of its faces. It may be desirable to use a base section of the type shown at 76', FIG. 14, for making some changes in the circuit and under other circumstances it would be desirable to have a connector body as shown at 6*a*, FIG. 28. Connector body 6*a* can be identical to connector body 6 except that it has notches 126 in the upper edge of sidewall 12*a*. The connector body 6*a* can thus be installed on a bundle of wires or a cable without interruption of service and it can, like the connector body 6, receive two identical connector bodies, again without interruption of service. The use of a connector body of the type shown in FIG. 28 will thus expand the number and types of circuit modifications which can be carried out without interruption of any of the circuits.

The electrical contact terminals, FIGS. 3 and 4, used in the practice of the invention have several advantages which render them particularly suited for use in the connector assembly. As previously mentioned, each terminal 32 is formed by stamping and forming operations as a single piece which is assembled to the body member by merely inserting the upper plate-like member 38 through an opening in the body member. The lower portion of the terminal, the receptacle portion 36, has a self-contained spring system by means of which electrical contact is established between the contact portions 50 of the receptacle portion of one terminal and the plate-like conductor-receiving portion 38 of another terminal as shown in FIG. 4. In other words, the mated termial devices of FIG. 4 do not require any external support for the maintenance of electrical contact between the terminals. This feature is of importance in the practice of the instant invention for the reason that the terminals in the intermediate body member are on closely spaced centers and there is not a large volume of insulating housing material serving to support the terminals; the terminals are entirely self-contained in a mechanical and electrical sense.

We claim:

1. A multi-purpose, multi-contact electrical connector comprising:

a generally prismatic insulating body having oppositely directed first and second faces and having laterally facing sides and ends extending between said faces, one of said sides constituting a wire-entry side, a plurality of double ended stamped and formed contact terminals mounted in, and extending through, said body, each of said terminals having a wire-receiving portion and a receptacle portion, said wire-receiving portions extending from said first face and said receptacle portions being on said second face, said wire-receiving portion of each terminal comprising a single plate-like member having a fixed end and a free end, a wire-receiving slot extending inwardly from said free end towards said fixed end, said receptacle portion being generally U-shaped and comprising a web and sidewalls extending from opposite edges of said web, said sidewalls having free ends which are remote from said web, said web being integral with said fixed end of said wire-receiving portion, said sidewalls defining spaced-apart planes which are intersected by the plane defined by said wire-receiving portion, said sidewalls having aligned slot means extending inwardly from said free ends, said slot means being dimensioned to receive said the wire-receiving portion of a like contact terminal, said terminals being arranged in two parallel rows with the terminals in one row being offset from the terminals in the other row, barrier walls extending across said second face and between said sides, each of said receptacle portions being between adjacent barrier walls, first and second rows of wire-receiving notch means in said wire-entry side, said first and second rows of notch means being beside said first and second faces respectively, said rows being offset from each other to permit mating of said body at either of said faces with another insulating body having a complementary face whereby, upon installing said connector upon a plurality of wires with said wires extending through said first row of notch means and with said wires in said wire-receiving slots of said terminals, said connector can be mated at either face with a connector having a complementary face.

2. A connector as set forth in claim 1, said first face being recessed and being surrounded by internal sidewalls and internal endwalls, said second face being dimensioned to fit within said internal walls.

3. A connector as set forth in claim 2, said connector having a offset flange integral with said body proximate to said second face, said second row of wire-receiving notches being in said flange.

4. A connector as set forth in claim 3, said side which is opposite to said wire-receiving side having notches therein which are in alignment with said terminals whereby, said connector can be installed on intermediate portions of wires.

5. A connector as set forth in claim 1 and a first plurality of wires, said wires extending as a bundle towards said connector parallel to said sides and along said wire-receiving side, portions of said wires extending laterally through said notches and across said first face, and portions of said wires being disposed in said wire-receiving slots of said terminals.

6. A connector and a first plurality of wires as set forth in claim 5 in combination with a complementary connecting device comprising a body member having a face which is identical to said first face, a second plurality of wires extending parallel to said first plurality of wires and to said complementary connecting device, through said notches in said complementary connecting device and being received in wire-receiving slots in said complementary connecting device, said complementary connecting device being mated to said second face of said connector whereby, said first plurality of wires are connected to said second plurality of wires.

7. A modular connector assembly for connecting a first plurality of wires to a second plurality of wires, said assembly comprising:

a base member and an intermediate body member, said intermediate body member being of insulating material having oppositely directed first and second faces, a plurality of stamped and formed first contact terminals mounted in said intermediate body member, each of said first terminals having a conductor-receiving portion and a receptacle portion, said conductor-receiving portions extending from said first face, said receptacle portions being on said second face, said conductor-receiving portion of each first terminal comprising a single plate-like member having a fixed end and a free end, a conductor-receiving slot extending inwardly from said free end towards said fixed end, said receptacle portion being generally U-shaped and comprising a web and sidewalls extending from opposite edges of said web, said sidewalls having free ends which are remote from said web, said conductor-receiving portion and said receptacle portion being formed from the same sheet metal blank so that said web is integral with said fixed end of said conductor-receiving portion, said sidewalls defining spaced-apart planes which are medially intersected by the plane defined by said conductor-receiving portion, aligned slot means in said sidewalls, said slot means being dimensioned to receive the conductor-receiving portion of a complementary terminal device, said contact terminals being arranged in two parallel rows in said intermediate body member, said terminals in each row being located on equally spaced center-lines, said terminals in each row being offset relative to said terminals in the other one of said rows by a distance equal to one half of the distance between adjacent terminals in each row, said base member having an internal face which is opposed to said second face, second contact terminals mounted on, and extending from, said internal face, said second contact terminals being substantially similar to said wire-receiving portions of said first contact terminals whereby, upon inserting wires into the wire-receiving slots of said second contact terminals, thereafter assembling said intermediate body member to said base member with said second face opposed to said internal face of said base member, said wires are electrically connected to said second terminals and said first terminals, and upon inserting wires into said wire-receiving portions of said first terminals, said groups of wire are electrically connected to each other.

8. A connector assembly as set forth in claim 7, said assembly having a cover member dimensioned to be assembled against said first face of said intermediate body member.

9. A connector assembly as set forth in claim 8, said body member and said base member each having a wire entry side, said body member and said base member each having wire-admitting notches in said wire entry sides to permit entry of wires connected to said terminals.

10. A connector assembly as set forth in claim 9, said intermediate body member having a flange on said wire entry side which extends towards said base member, said flange having notches therein which are in alignment with said notches in said base member, aligned notches in said flange and in said base forming enclosed wire gripping strain relief means for wires extending to said terminals in said base member.

11. A connector assembly as set forth in claim 10, said cover member having an integral flange extending towards said wire entry side of said intermediate body member, said flange on said cover member having notches therein which are in alignment with said notches in said intermediate body member, said notches in said intermediate body member and in said flange in said cover member forming enclosed wire gripping strain relief means for wires extending to said terminals in said intermediate body member.

12. A stamped and formed contact terminal which is adapted to have a conductor connected thereto and to be disengageably mated with at least one complementary terminal, said contact terminal comprising:

a conductor-receiving portion and a receptacle portion, said conductor-receiving portion comprising a single flat planar plate-like member having a fixed end and a free end, a conductor-receiving slot extending inwardly from said free end towards said fixed end, said receptacle portion being generally U-shaped and comprising a web and flat planar sidewalls extending from opposite edges of said web, said sidewalls having sidewall free ends which are remote from said web, said conductor-receiving portion and said receptacle portion being formed from the same sheet metal blank whereby said web is integral with said fixed end of said conductor-receiving portion, said sidewalls extending in the direction which is opposite to the direction of said conductor-receiving portion and defining spaced-apart planes which extend normally of, and which are medially intersected by, the plane defined by said conductor-receiving portion, aligned receptacle slots in said sidewalls, said receptacle slots extending inwardly from said sidewall free ends towards said web, said receptacle slots being dimensioned to receive, and establish electrical contact with, a further conductor-receiving portion of a complementary terminal which is identical to said terminal whereby, a conductor can be electrically connected to said contact terminal by moving said conductor laterally of its axis and into said conductor-receiving slot, and said terminal can be disengageably mated to a first complementary terminal which has a conductor-receiving portion upon movement of said conductor-receiving portion of said first complementary terminal into said receptacle slots in said sidewalls, and said terminal can be disengageably mated with a second complementary terminal having a receptacle portion by moving said conductor-receiving portion of said terminal into said receptacle slots in the sidewalls of the receptacle portion of said second complementary terminal.

* * * * *